US009761399B1

(12) United States Patent
Sorenson, Sr. et al.

(10) Patent No.: US 9,761,399 B1
(45) Date of Patent: Sep. 12, 2017

(54) SOLENOID ACTUATED CIRCUIT BREAKER WITH LOCKING CLIP

(71) Applicants: Richard Sorenson, Sr., Ft. Lauderdale, FL (US); Michael Fasano, Watertown, CT (US); James Bugryn, Bristol, CT (US)

(72) Inventors: Richard Sorenson, Sr., Ft. Lauderdale, FL (US); Michael Fasano, Watertown, CT (US); James Bugryn, Bristol, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

(21) Appl. No.: 15/141,188

(22) Filed: Apr. 28, 2016

(51) Int. Cl.

| | |
|---|---|
| ***H01H 3/20*** | (2006.01) |
| ***H01H 17/00*** | (2006.01) |
| ***H01H 71/02*** | (2006.01) |
| ***H01H 71/10*** | (2006.01) |
| ***H01H 9/54*** | (2006.01) |
| ***H01H 71/24*** | (2006.01) |

(52) U.S. Cl.
CPC ..... *H01H 71/0228* (2013.01); *H01H 9/54* (2013.01); *H01H 71/025* (2013.01); *H01H 71/1018* (2013.01); *H01H 71/24* (2013.01)

(58) Field of Classification Search
CPC .. H01H 71/02228; H01H 9/54; H01H 71/025; H01H 71/1018; H01H 71/24; H01H 3/00; H01H 3/02; H01H 3/04; H01H 3/22; H01H 3/20; H01H 3/227; H01H 3/24; H01H 3/26; H01H 3/28; H01H 3/30; H01H 3/32; H01H 17/00; H01H 21/00; H01H 21/04; H01H 21/36; H01H 71/00; H01H 71/02; H01H 71/0264; H01H 71/52; H01H 71/10; H01H 71/66; H01H 71/70; H01H 2221/016
USPC ... 200/331, 50.01, 50.1, 443, 529, 539, 547, 200/548, 553, 557, 556, 565, 290, 293, 200/302.3, 318.1, 329, 330, 332, 333, 200/339, 345
See application file for complete search history.

(56) References Cited

U.S. PATENT DOCUMENTS

| | | | | |
|---|---|---|---|---|
| 3,843,852 | A * | 10/1974 | Lockard ..... | H01H 15/005 200/16 D |
| 4,974,192 | A | 11/1990 | Face et al. | |
| 5,580,268 | A | 12/1996 | Miyazawa | |
| 7,255,570 | B1 | 8/2007 | Feldman et al. | |

(Continued)

*Primary Examiner* — Anthony R. Jimenez
(74) *Attorney, Agent, or Firm* — St. Onge Steward Johnston & Reens, LLC

(57) ABSTRACT

A circuit breaker includes a housing having a channel formed therein, the channel being defined by at least one side wall having a detent formed therein, a circuit breaker mechanism, a switch handle configured to toggle the circuit breaker, and an actuator module adapted to move the switch handle from the off position to the on position. The module includes a flexible portion having a protrusion formed thereon, the protrusion being sized, shaped and located to engage the detent when the module is mounted within the channel. The module also includes a locking clip moveable from an unlocked position, in which flexing of the at least one flexible portion is permitted, and a locked position, in which flexing of the at least one flexible portion is limited or prevented, such that when the module is mounted within the channel, removal of the module is inhibited.

20 Claims, 6 Drawing Sheets

(56) References Cited

U.S. PATENT DOCUMENTS

| | | | | |
|---|---|---|---|---|
| 7,367,812 | B2 | 5/2008 | Shih et al. | |
| 9,312,088 | B2 | 4/2016 | Sorenson, Sr. | |
| 2006/0244557 | A1 | 11/2006 | Sorenson | |
| 2015/0101914 | A1* | 4/2015 | Sorenson, Sr. ..... | H01H 71/12<br>200/331 |

* cited by examiner

SOLENOID ACTUATED CIRCUIT BREAKER WITH LOCKING CLIP

FIELD OF THE INVENTION

The invention relates to remotely operated circuit breakers in general, and more particularly, to circuit breakers having a breaker handle that is remotely operated using a modular solenoid mechanism.

BACKGROUND OF THE INVENTION

A circuit breaker is a device that can be used to protect an electrical circuit from damage caused by an overload or a short circuit. If a power surge occurs in a circuit protected by the circuit breaker, for example, the breaker will trip. This will cause a breaker that was in the "on" position to flip to the "off" position, and will interrupt the electrical power leading from that breaker. By tripping in this way, a circuit breaker can prevent a fire from starting on an overloaded circuit, and can also prevent the destruction of the device that is drawing the electricity or other devices connected to the protected circuit.

A standard circuit breaker has a line and a load. Generally, the line receives incoming electricity, most often from a power company. This is sometimes referred to as the input into the circuit breaker. The load, sometimes referred to as the output, feeds out of the circuit breaker and connects to the electrical components being fed from the circuit breaker. A circuit breaker may protect an individual component connected directly to the circuit breaker, for example, an air conditioner, or a circuit breaker may protect multiple components, for example, household appliances connected to a power circuit which terminates at electrical outlets.

A circuit breaker can be used as an alternative to a fuse. Unlike a fuse, which operates once and then must be replaced, a circuit breaker can be reset (either manually or automatically) to resume normal operation. When the power to a circuit shuts down, an operator can inspect the electrical panel to see which breaker has tripped to the "off" position. The breaker can then be flipped to the "on" position and power will resume.

In general, a circuit breaker has two contacts located inside of a housing. Typically, the first contact is stationary, and may be connected to either the line or the load. Typically, the second contact is movable with respect to the first contact, such that when the circuit breaker is in the "off," or tripped position, a gap exists between the first and second contact, and the line is disconnected from the load.

In some applications, it is desirable to operate a circuit breaker remotely. For example, an operator may typically trip a circuit breaker manually to de-energize a protected circuit so that it can be inspected or serviced. However in some circuits, operating the breaker can produce a dangerous arc, creating a safety hazard for the operator. In still other circuits, the circuit breaker may be located in a confined or hazardous environment. In these situations, it is beneficial to operate the circuit breaker remotely. In other applications, such as in large office buildings, it may be desirable, for example, to automatically trip circuits powering large banks of overhead lights, such that entire floors or sections of floors can be automatically shut down in response to timed signals at night without requiring that each individual light switch have a timer.

Known approaches to remotely controlling circuit breakers include incorporating a mechanism into the circuit breaker which can intentionally trip the circuit breaker mechanism and/or reset it. Examples of such mechanisms are solenoids or motors used to activate the trip mechanism, and solenoids or motors which are used to reset the circuit breaker by rearming the trip mechanism, such as by physically moving the switch handle using a solenoid or other motor or mechanism that can be remotely operated.

However, the lifespan of a solenoid employed to reset a circuit breaker using the switching handle may be limited. In some cases, the rearming solenoid may wear out or otherwise fail far before the other components of the circuit breaker. This can require an unacceptably premature replacement of the entire circuit breaker as a unit, increasing costs.

In order to increase the number of cycles that such circuit breaker units can endure before failure, it would be conceivable to increase the robustness of the solenoid. However, this may increase the costs, power consumption, and/or size of the solenoid beyond acceptable limits.

U.S. Patent Application Publication No. 2015/0101914 set out an improvement to this approach by disclosing a remotely resettable circuit breaker which includes a modular, replaceable resetting mechanism including a solenoid.

The present invention, however, aims to even further improve upon the design disclosed in U.S. Patent Application Publication No. 2015/0101914 by providing an improved mechanism for facilitating the installation and removal of the modular, replaceable resetting mechanism with respect to the housing of the circuit breaker.

SUMMARY OF THE INVENTION

In accordance with one aspect of the present invention, a circuit breaker includes a housing having a channel formed therein, the channel being defined by at least one side wall having a detent formed therein, a circuit breaker mechanism having a tripped state and an untripped state, a switch handle having an off position and an on position and configured to toggle the circuit breaker between the tripped state and the untripped state, and an actuator module adapted to move the switch handle from the off position to the on position. The actuator module is a self-contained modular assembly adapted to be attached to and removed from the housing as a unit, the actuator module including at least one flexible portion having a protrusion formed thereon, the protrusion being sized, shaped and located to engage the detent formed in the channel of the housing when the actuator module is mounted within the channel. The actuator module also includes a locking clip moveable from an unlocked position, in which flexing of the at least one flexible portion is permitted, and a locked position, in which flexing of the at least one flexible portion is limited or prevented, such that when the actuator module is mounted within the channel so that the protrusion engages the detent and the locking clip is in the locked position, removal of the actuator module is inhibited.

In some embodiments, the channel in the housing is defined by a pair of side walls facing one another, each of the pair of side walls having a detent formed therein. In some embodiments, the at least one flexible portion of the actuator module comprises a pair of legs, each having an outwardly extending protrusion formed thereon.

In some embodiments, the protrusion has a rounded or tapered forward surface adapted to promote flexing of the at least one flexible portion as the actuator module is slid into the channel of the housing. In certain of these embodiments, the protrusion has a rounded or tapered rearward surface to promote flexing of the at least one flexible portion as the protrusion is disengaged from the detent while the actuator module is removed from the channel of the housing.

In some embodiments, the locking clip comprises a generally flat member generally defining a plane, and the locking clip is slideable within the plane from the unlocked position to the locked position. In some embodiments, the locking clip is further moveable from the locked position to the unlocked position so as to facilitate removal of the actuator module from the channel of the housing. In certain of these embodiments, in the unlocked position the locking clip is positioned such that the pair of legs are flexible toward one another, and in the locked position the locking clip is positioned between the legs such that flexing of the legs toward one another is limited or prevented.

In some embodiments, the circuit breaker further includes a first plug connection disposed on the actuator module which engages a second plug connection disposed in the channel of the housing as the actuator module is slid into the channel. In certain of these embodiments, the first plug connection comprises a male plug connection extending from the actuator module and the second plug connection comprises a female plug connection formed within the channel.

In some embodiments, the actuator module further includes a solenoid. In some embodiments, the circuit breaker further includes a wiring harness having a terminal in electrical communication with the actuator module. In certain of these embodiments, the actuator module is remotely operable in response to a signal received by the terminal.

In some embodiments, the circuit breaker further includes a voltage coil configured to selectively trip the circuit breaker mechanism. In certain of these embodiments, the voltage coil is configured to trip the circuit breaker mechanism in response to detection of at least one of a ground fault and an earth leakage. In certain embodiments, the voltage coil is configured to trip the circuit breaker mechanism in response to a signal.

In accordance with another aspect of the present invention, a circuit breaker includes a housing having a channel formed therein, the channel being defined by a pair of side walls facing one another, each of the pair of side walls having a detent formed therein, a switch handle having an off position and an on position, and an actuator module adapted to move the switch handle from the off position to the on position. The actuator module is a self-contained modular assembly adapted to be attached to and removed from the housing as a unit, the actuator module including a pair of legs, each having an outwardly extending protrusion formed thereon, the protrusion being sized, shaped and located to engage the detents formed in the channel of the housing when the actuator module is mounted within the channel. The actuator module also includes a locking clip comprising a generally flat member generally defining a plane, the locking clip being slideable within the plane from an unlocked position, in which the locking clip is positioned such that the pair of legs are flexible toward one another, to a locked position, in which the locking clip is positioned between the legs such that flexing of the legs toward one another is limited or prevented, such that when the actuator module is mounted within the channel so that the protrusions engage the detents and the locking clip is in the locked position, removal of the actuator module is inhibited.

Other objects of the invention and its particular features and advantages will become more apparent from consideration of the following drawings and accompanying detailed description.

DETAILED DESCRIPTION OF THE INVENTION

Figure 1:
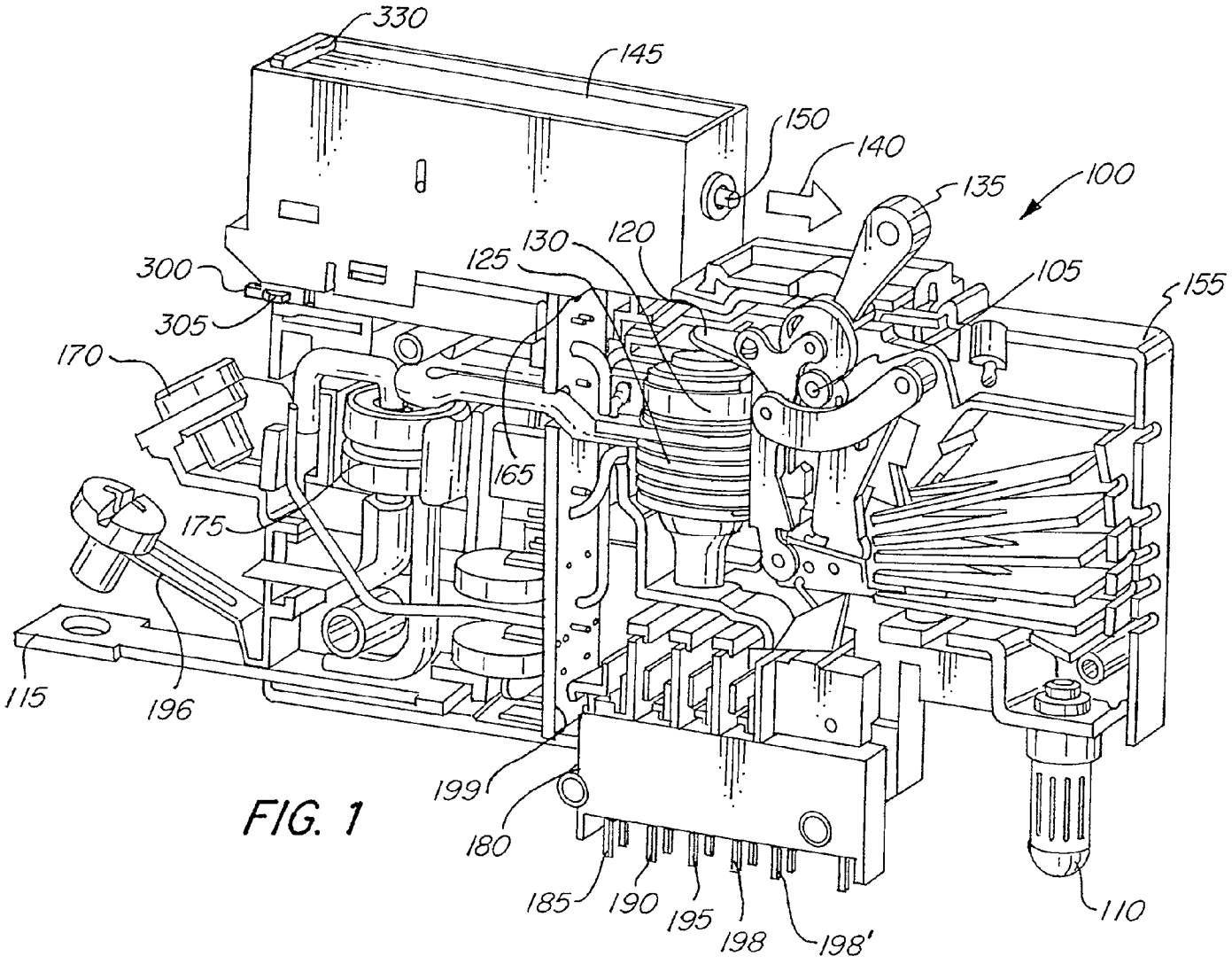
FIG. 1 is a partially cut away perspective view of a circuit breaker illustrating aspects of the invention.

Referring first to FIGS. 1, 3A, 3B and 4 illustrated is a circuit breaker 100 according to aspects of the invention.

Circuit breaker 100 includes a circuit breaker mechanism 105 which controls current flow between a line terminal 110 and a load terminal 115. The line terminal 110 receives electricity from a power source such as a generator (not shown), which in some applications is supplied by a power company. Current may flow between line terminal 110 and load terminal 115 when mechanism 105 is in an untripped state. Current cannot flow between line terminal 110 and load terminal 115 when mechanism 105 is in a tripped state.

Mechanism 105 may be tripped by a tripping mechanism 120. Tripping mechanism 120 may be activated by fault detector 125.

Fault detector 125 is configured to activate the tripping mechanism 120 when a fault condition occurs, such as excess current. In some applications, fault detector 125 is a solenoid which is disposed in series with the line and load terminals. If the current through the solenoid exceeds a certain level, the solenoid generates an electromagnetic field sufficient to activate the tripping mechanism 120. Optionally, such solenoid may also incorporate a plunger or other armature which activates the tripping mechanism when the current exceeds a certain level (not shown).

It is understood that other fault detection methods may also be employed to trip the tripping mechanism upon the occurrence of a specific condition.

Optionally, tripping mechanism 120 may be tripped by voltage coil 130. Voltage coil 130 is configured to allow tripping mechanism 120 to be activated upon the occurrence of a specific condition or upon receiving a remote signal. Tripping mechanism 120 may also be tripped manually by moving switch handle 135 to an "off" position.

Tripping mechanism 120 may be reset (untripped) manually by moving switch handle 135 in the direction indicated by arrow 140, to an "on" position (shown). Switch handle 135 may also be moved to the on position using remote resetting actuator module 145.

Module 145 includes a piston 150 which is configured to extend in the direction of arrow 140 to move switch handle 135 into the on position when module 145 is activated. Those having skill in the art will understand that other types of actuators may be employed without departing from the invention.

Module 145 is removably attached to the housing 155 of breaker 100 by way of legs 300 with outwardly extending protrusions 305 that cooperate with detents 310 formed in a channel 315 within the housing 155 in which the module 145 is slideably received, as described in more detail below.

Module 145, and specifically the solenoid 200 thereof, is removably electrically connected to breaker 100 using a male plug connection 165 extending from the module 145 which engages a female plug connection 166 formed in the channel 315 within the housing 155 as the module 145 is slid into the channel 315 for mounting on the housing 155. Thus, plug connection 165, 166 is preferably configured to electrically connect module 145 to breaker 100 as module 145 is installed. This can have advantages over more traditional configurations involving flying leads or the like of preventing stray wires, increasing the robustness of the connection, and/or improving ease of installation. Those having skill in the art will understand that various other configurations of plug connection 165, 166 are possible without departing from the invention, including other types of plugs.

Breaker 100 may optionally also include a neutral terminal 170 and a ground fault sensor 175. Ground fault sensor may be configured to activate tripping mechanism 120 using voltage coil 130 when a fault condition is detected.

Breaker 100 may also includes a plug 180 which may be interfaced with a wiring harness (not shown) or another suitable external connection. Plug 180 is configured to communicate electrically with various components of breaker 100, for example, to facilitate signaling to and from an external device or system, such as a power distribution system. Transmission of signals within breaker 100, including from plug 180, may be facilitated by a printed circuit board ("PCB") 199, or other suitable wiring or interconnections.

As shown, plug 180 includes remote resetting terminals 185, 190, which may be used to transmit a reset signal to module 145 to activate piston 150 of solenoid 200. Plug 180 also includes a voltage coil terminal 195, which may be used to transmit an activation signal to voltage coil 130. Here, voltage coil may be internally grounded, thus only one terminal is required.

Plug 180 may also include additional terminals 198 and 198' which may be used to connect an auxiliary switch 197 to activate one or more of the components of breaker 100 as desired and/or to provide a signal indicative of circuit breaker status to an external device or system, such as a power distribution system. For example, this status signal may indicate that the breaker is untripped, that the breaker has been tripped due to overcurrent, that the breaker has been tripped due to a ground fault, etc.

Those having skill in the art will understand that other arrangements of signals may be supported by plug 180 without departing from the invention.

Figure 2:
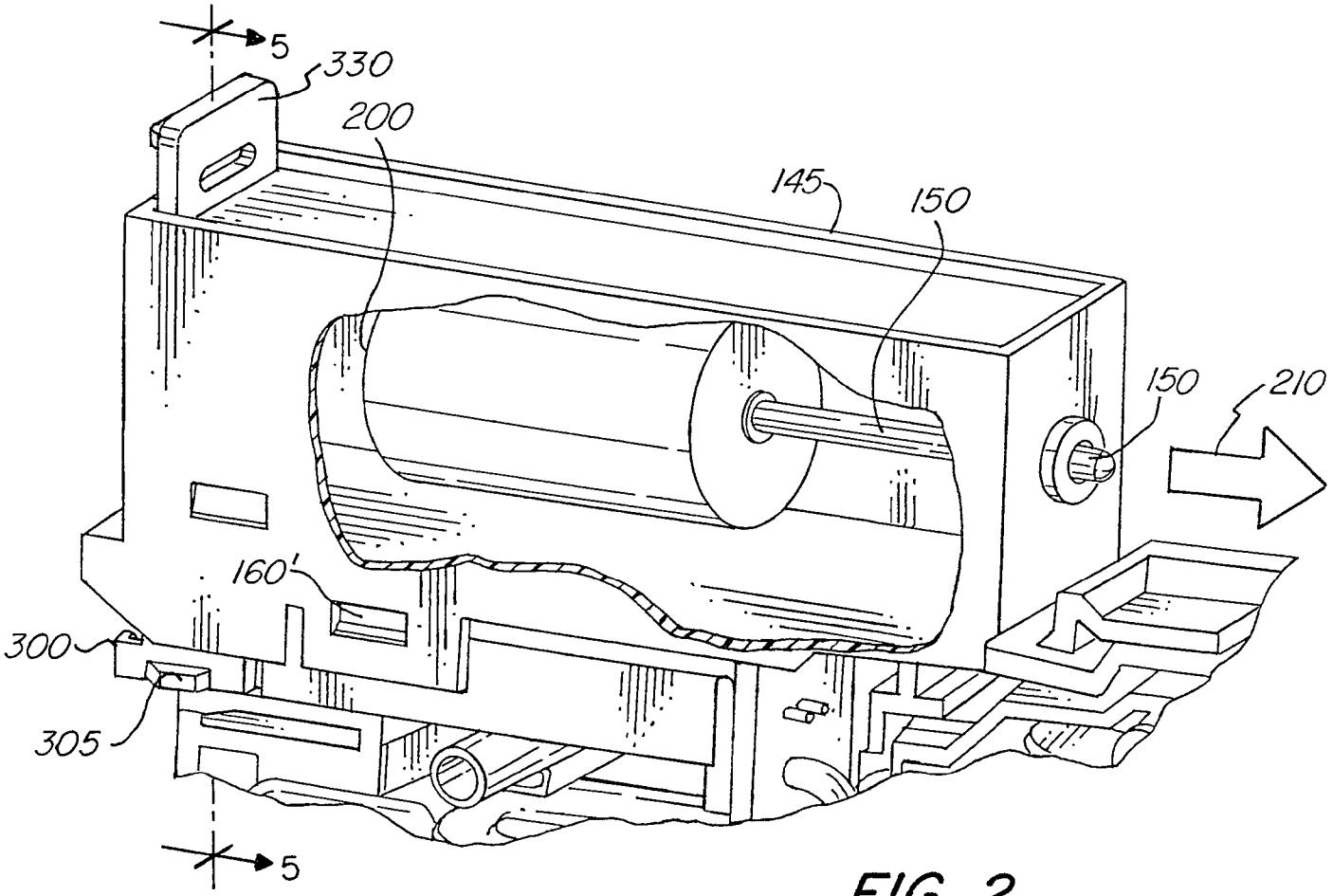
FIG. 2 is a partially cut away perspective view of the modular actuator module portion of the circuit breaker shown in FIG. 1 with the actuator module portion installed on the body of circuit breaker but shown in an unlocked state.

FIG. 2 is a cutaway view of remote resetting module 145, illustrating aspects of the invention.

Module 145 includes a solenoid 200. Solenoid 200 is configured to extend piston 150 in the direction indicated by arrow 210 when solenoid 200 is energized. Piston 150 is shown configured as an armature of solenoid 200. However, those having skill in the art will understand that other types of electromechanical actuators may be used without departing from the invention.

Solenoid 200 may be activated using a remote signal, such as a signal supplied via PCB 199 from remote resetting terminals 185, 190.

Solenoid 200 may be configured such that piston 150 is biased to a retracted position (shown). In this case, piston 150 will revert to the retracted position unless solenoid 200 is energized. This can have the advantage of preventing switch handle 135 (FIG. 1) from being obstructed by piston 150 due to a power fault or other malfunction.

Figure 3A:
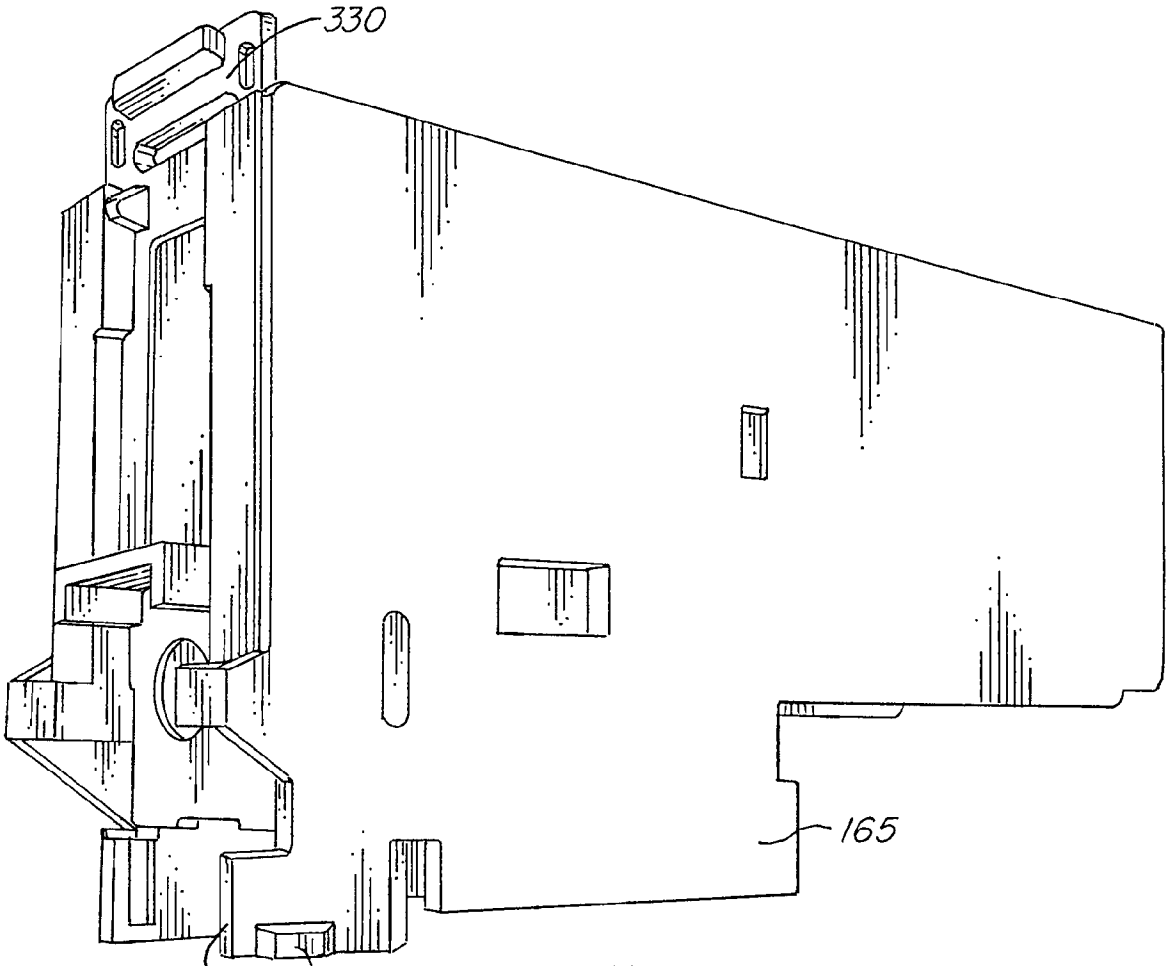
FIG. 3A is a perspective view of the modular actuator module portion of the circuit breaker shown in FIG. 1 shown in an unlocked position.
Figure 3B:
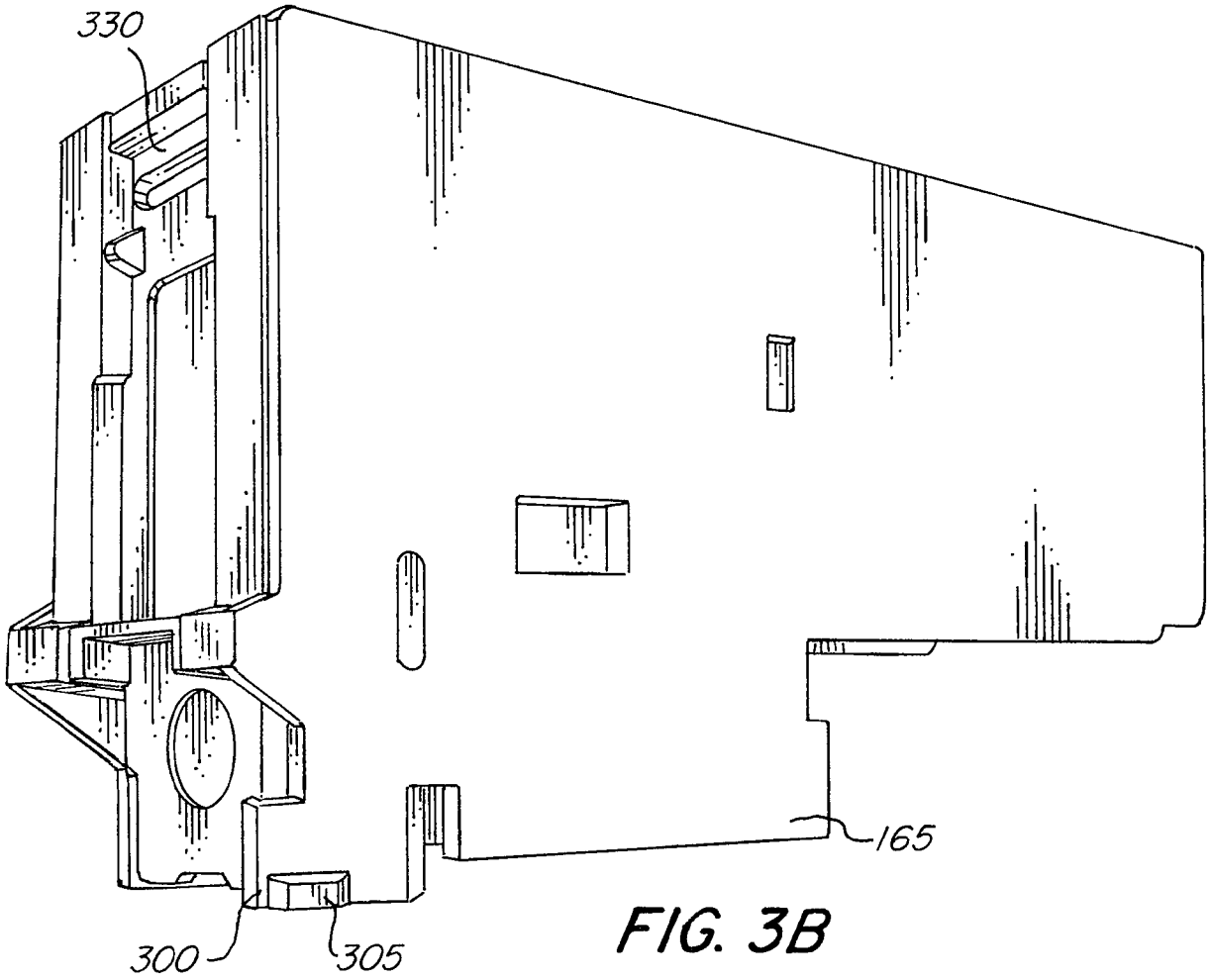
FIG. 3B is a perspective view of the modular actuator module portion of the circuit breaker shown in FIG. 1 shown in a locked position.
Figure 4:
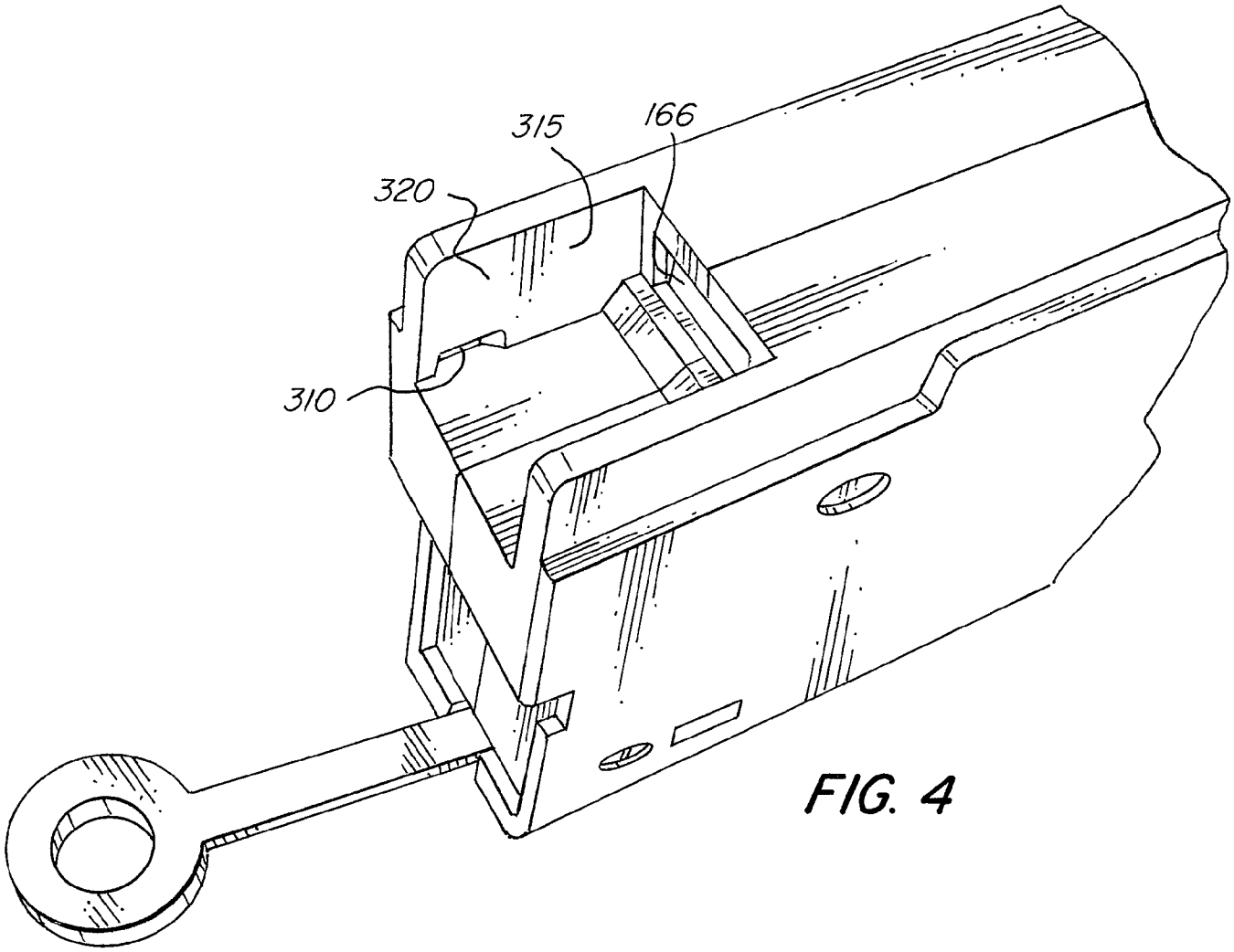
FIG. 4 is a partial perspective view of the actuator module receiving portion of the body of the circuit breaker shown in FIG. 1.
Figure 5A:
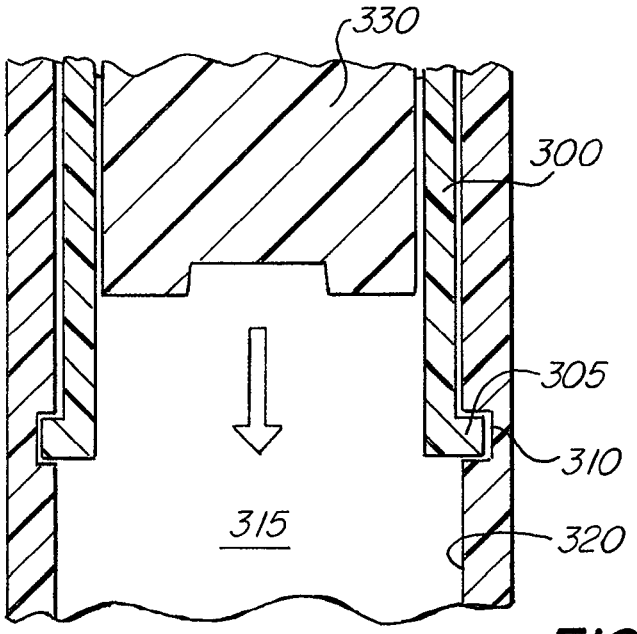
FIG. 5A is a partial cross-sectional view of the circuit breaker, taken along line 5-5 of FIG. 2, showing the modular actuator module portion installed on the body of the circuit breaker but shown in an unlocked state.
Figure 5B:
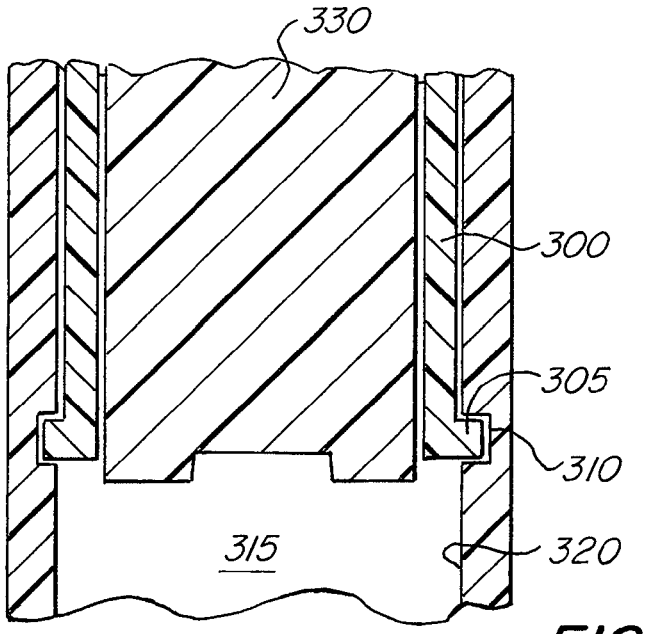
FIG. 5B is a partial cross-sectional view of the circuit breaker, taken along line 5-5 of FIG. 2, showing the modular actuator module portion installed on the body of the circuit breaker and shown in an unlocked position.

Referring now specifically to FIGS. 5A and 5B, in combination with FIGS. 3A, 3B and 4, the module mounting aspect of the present invention is shown in greater detail. As mentioned above, the module 145 is removably attached to the housing 155 of breaker 100 by way of legs 300 with outwardly extending protrusions 305 that cooperate with detents 310 formed in a channel 315 within the housing 155 in which the module 145 is slideably received.

FIGS. 4, 5A and 5B show the channel 315 formed within the housing 155 in more detail. Specifically, the channel 315 is defined by two generally parallel spaced apart walls 320, which walls 320 are also generally parallel to the outer side walls of the housing 155. Each of the walls 320 has a detent 310 formed, the purpose of which is described in more detail below. As discussed more fully above, a female plug connection 166 is provided at an end of the channel 315, which female plug connection 166 electrically communicates with male plug connection 165 on module 145 so as to provide an electrical connection between module 145 and the body of circuit breaker 100.

Referring more specifically now to FIGS. 3A, 3B, 5A and 5B the legs 300 of module 145 are shown in more detail. As can be seen, the legs 300 are defined by outwardly facing surfaces that are dimensioned to be in generally sliding engagement with the walls 320 of the channel 315 formed in the housing 155. Each of the legs 300 includes an outwardly extending protrusion 305 that is sized, shaped and positioned so as to cooperate with a corresponding detent 310 formed in the walls 320 of the channel 315 when the module 145 is fully seated within the channel 315.

The protrusions 305 preferably have rounded (as shown in the FIGS.) or sloped forward edges to facilitate installation of the module 145 in the channel 315. More specifically, as the module 145 is inserted into the channel 315, the protrusions 305 on the legs 300 come into contact with the walls 320 of channel 315. Further force applied on the module 145 causes the legs 300 to flex inwardly toward one another due to the cooperation between the protrusions 305 and the walls 320 of the channel 315. This flexing is promoted by the rounded or sloped configuration of the protrusions 305.

As the module is slid further into the channel 315, the protrusions 305 eventually align with the detents 310 formed in the walls 320 of the channel 315, such that the protrusions 305 engage the detents 310 and the legs 300 snap back outwardly toward their original positions. At the same time, the male plug connection 165 positioned on the module 145 engages the female plug connection 166 provided in the end of the channel 315 such that the module 145 now receives power from the body of the circuit breaker 100. The module 145 is now mounted in place within the channel 315.

However, since it is intended that the module 145 be readily replaceable, the protrusions 305 preferably have rounded (as shown in the FIGS.) or sloped rearward edges to facilitate removal of the module 145 from the channel 315. Such can be accomplished by reversing the above-described insertion steps.

Specifically, the module 145 is grasped and a pulling force is applied. As the module 145 is removed from the channel 315, the protrusions 305 on the legs 300 are pulled out of the detents 310 and again come into contact with the walls 320 of channel 315. Further pulling force applied on the module 145 causes the legs 300 to flex inwardly toward one another due to the cooperation between the protrusions 305 and the walls 320 of the channel 315.

As the module 145 is slid further out of the channel 315, the protrusions 305 eventually clear the walls 320 of the channel 315, such that the legs 300 snap back outwardly toward their original positions. At the same time, the male plug connection 165 positioned on the module 145 has been disengaged from the female plug connection 166 provided in the end of the channel 315 such that the module 145 now no longer receives power from the body of the circuit breaker 100.

Of course, it will be recognized that during use, the unintentional unplugging of the module 145 from the body of the circuit breaker 100 is to be avoided. Toward this end, a locking clip 330 is provided, the purpose of which is to lock the module 145 in place in the channel 315 once it has been mounted and snapped into place. In the particular embodiment shown in the FIGS., the locking clip 330 takes the form of a guillotine-style member that is slideable up and down. However, those skilled in the art will recognize that other configurations for the locking clip 330 are certainly possible.

The locking clip 330 is moveable (indicated by arrow 335 in FIG. 5A) between an unlocked position (shown in FIGS. 2, 3A and 5A), in which position the mounting clip 330 does not interfere with inward flexing of the legs 300, thereby allowing for the module 145 to be slid into and removed from the channel 315, and a locked position (shown in FIGS. 1, 3B and 5B), in which position the mounting clip 330 limits or prevents inward flexing of the legs 300 (best seen in FIG. 5B), thereby preventing the protrusions 305 from disengaging the detents 310 once the module 145 has been mounted within the channel 315.

As a consequence, once the module 145 has been mounted within the channel with the protrusions 305 snapped into the detents 310, and the locking clip 330 has been moved to the locked position, it is very difficult, if not impossible without causing permanent damage, for the module 145 to be removed from the channel 315 without first moving the locking clip 330 back to the unlocked position. However, if it is desired to replace the module 145, it is an easy matter for an operator to simply move the locking clip 330 to the unlocked position, and then unsnap the module 145 from its mounted position and slide it out of the channel 315, as described above.

The present invention, therefore, provides an improved mechanism for facilitating the installation and removal of the modular, replaceable resetting mechanism with respect to the body of the circuit breaker.

Although the invention has been described with reference to a particular arrangement of parts, features and the like, these are not intended to exhaust all possible arrangements or features, and indeed many modifications and variations will be ascertainable to those of skill in the art.

What is claimed is:

1. A circuit breaker comprising:

a housing having a channel formed therein, the channel being defined by at least two side walls, each having a detent formed therein, the detents facing each other with the channel therebetween;

a circuit breaker mechanism having a tripped state and an untripped state;

a switch handle having an off position and an on position and configured to toggle the circuit breaker between the tripped state and the untripped state; and, an actuator module adapted to move the switch handle from the off position to the on position, wherein the actuator module is a self-contained modular assembly adapted to be attached to and removed from the housing as a unit, the actuator module comprising:

at least two legs, each having an outwardly extending protrusion formed thereon, the protrusions facing away from each other and being sized, shaped and located to engage the detents formed in the side walls of the channel of the housing when the actuator module is mounted within the channel; and a locking clip moveable from an unlocked position, in which flexing of the legs toward each other is permitted, and a locked position, in which flexing of the legs toward each other is limited or prevented, such that when the actuator module is mounted within the channel so that the protrusions engage the detents and the locking clip is in the locked position, removal of the actuator module is inhibited.

2. The circuit breaker of claim 1, wherein the locking clip comprises a generally flat member generally defining a plane, and wherein the locking clip is slideable within the plane from the unlocked position to the locked position.

3. The circuit breaker of claim 1, wherein the locking clip is further moveable from the locked position to the unlocked position so as to facilitate removal of the actuator module from the channel of the housing.

4. The circuit breaker of claim 1, wherein the at least two legs comprises a pair of legs and wherein in the unlocked position the locking clip is positioned such that the pair of legs are flexible toward one another, and wherein in the locked position the locking clip is positioned between the legs such that flexing of the legs toward one another is limited or prevented.

5. The circuit breaker of claim 1, wherein the actuator module further comprises a solenoid.

6. The circuit breaker of claim 1, wherein the protrusion has a rounded or tapered forward surface adapted to promote flexing of the at least one flexible portion as the actuator module is slid into the channel of the housing.

7. The circuit breaker of claim 6, wherein the protrusion has a rounded or tapered rearward surface to promote flexing of the at least one flexible portion as the protrusion is disengaged from the detent while the actuator module is removed from the channel of the housing.

8. The circuit breaker of claim 1, further comprising a first plug connection disposed on the actuator module which engages a second plug connection disposed in the channel of the housing as the actuator module is slid into the channel.

9. The circuit breaker of claim 8 wherein the first plug connection comprises a male plug connection extending from the actuator module and the second plug connection comprises a female plug connection formed within the channel.

10. The circuit breaker of claim 1, further comprising a wiring harness having a terminal in electrical communication with the actuator module.

11. The circuit breaker of claim 10, wherein the actuator module is remotely operable in response to a signal received by the terminal.

12. The circuit breaker of claim 1, further comprising a voltage coil configured to selectively trip the circuit breaker mechanism.

13. The circuit breaker of claim 12, wherein the voltage coil is configured to trip the circuit breaker mechanism in response to detection of at least one of a ground fault and an earth leakage.

14. The circuit breaker of claim 12, wherein the voltage coil is configured to trip the circuit breaker mechanism in response to a signal.

15. A circuit breaker comprising:

a housing having a channel formed therein, the channel being defined by a pair of side walls facing one another, each of the pair of side walls having a detent formed therein, the detents facing each other across the channel;

a switch handle having an off position and an on position; and, an actuator module adapted to move the switch handle from the off position to the on position, wherein the actuator module is a self-contained modular assembly adapted to be attached to and removed from the housing as a unit, the actuator module comprising:

a pair of legs, each having an outwardly extending protrusion formed thereon, the protrusions facing away from each other and being sized, shaped and located to engage the detents formed in the side walls of the channel of the housing when the actuator module is mounted within the channel; and a locking clip comprising a generally flat member generally defining a plane, and wherein the locking clip is slideable within the plane from an unlocked position, in which the locking clip is positioned such that the pair of legs are flexible toward one another, to a locked position, in which the locking clip is positioned between the legs such that flexing of the legs toward one another is limited or prevented, such that when the actuator module is mounted within the channel so that the protrusions engage the detents and the locking clip is in the locked position, removal of the actuator module is inhibited.

16. The circuit breaker of claim 15, wherein the locking clip is further moveable from the locked position to the unlocked position so as to facilitate removal of the actuator module from the channel of the housing.

17. The circuit breaker of claim 15, wherein the protrusion has a rounded or tapered forward surface adapted to promote flexing of the at least one flexible portion as the actuator module is slid into the channel of the housing.

18. The circuit breaker of claim 17, wherein the protrusion has a rounded or tapered rearward surface to promote flexing of the at least one flexible portion as the protrusion is disengaged from the detent while the actuator module is removed from the channel of the housing.

19. The circuit breaker of claim 15, further comprising a first plug connection disposed on the actuator module which engages a second plug connection disposed in the channel of the housing as the actuator module is slid into the channel.

20. The circuit breaker of claim 19 wherein the first plug connection comprises a male plug connection extending from the actuator module and the second plug connection comprises a female plug connection formed within the channel.

* * * * *